US010047476B2

(12) United States Patent
Wang

(10) Patent No.: US 10,047,476 B2
(45) Date of Patent: Aug. 14, 2018

(54) PRODUCTION METHOD FOR HIGH-LOW PILE TOWEL

(71) Applicant: LOFTEX CHINA LTD., Binzhou, Shandong (CN)

(72) Inventor: Hongxing Wang, Binzhou (CN)

(73) Assignee: LOFTEX CHINA LTD., Shangdong (CN)

( * ) Notice: Subject to any disclaimer, the term of this patent is extended or adjusted under 35 U.S.C. 154(b) by 0 days.

(21) Appl. No.: 15/109,438

(22) PCT Filed: Apr. 24, 2014

(86) PCT No.: PCT/CN2014/076138

§ 371 (c)(1),
(2) Date: Jun. 30, 2016

(87) PCT Pub. No.: WO2015/100886

PCT Pub. Date: Jul. 9, 2015

(65) Prior Publication Data

US 2016/0326689 A1 Nov. 10, 2016

(30) Foreign Application Priority Data

Dec. 31, 2013 (CN) ..... 2013 1 0749415

(51) Int. Cl.

| | |
|---|---|
| ***D06M 15/11*** | (2006.01) |
| ***D03D 27/08*** | (2006.01) |
| ***D06M 13/02*** | (2006.01) |
| ***D06M 13/03*** | (2006.01) |
| ***D06L 1/14*** | (2006.01) |
| ***D06M 13/402*** | (2006.01) |
| ***D06M 16/00*** | (2006.01) |
| ***D06P 1/00*** | (2006.01) |
| ***D06L 4/40*** | (2017.01) |
| ***D06L 4/12*** | (2017.01) |
| ***D06L 4/13*** | (2017.01) |
| ***D06L 4/70*** | (2017.01) |
| ***D06P 1/38*** | (2006.01) |
| ***D06P 1/673*** | (2006.01) |

(52) U.S. Cl.

CPC ..... *D06M 15/11* (2013.01); *D03D 27/08* (2013.01); *D06L 1/14* (2013.01); *D06L 4/12* (2017.01); *D06L 4/13* (2017.01); *D06L 4/40* (2017.01); *D06L 4/70* (2017.01); *D06M 13/02* (2013.01); *D06M 13/03* (2013.01); *D06M 13/402* (2013.01); *D06M 16/003* (2013.01); *D06P 1/0004* (2013.01); *D06P 1/38* (2013.01); *D06P 1/6735* (2013.01); *D06M 2200/50* (2013.01)

(58) Field of Classification Search

CPC .... D06M 16/003; D06M 13/02; D06M 13/03; D06M 13/402; D06M 15/11; D06L 1/14; D06L 4/40; D06L 4/12; D06L 4/13; D06L 4/70; D03D 27/08; D06P 1/0004

See application file for complete search history.

(56) References Cited

FOREIGN PATENT DOCUMENTS

CN 103054499 * 4/2013

* cited by examiner

*Primary Examiner* — Amina S Khan

(74) *Attorney, Agent, or Firm* — Raymond Y. Chan; David and Raymond Patent Firm

(57) ABSTRACT

The present invention falls within the field of textile products, and specifically provides a brand new production method for a high-low pile towel. The method breaks through the visual monotony of conventional towels and a traditional design method in which two or three adjacent conventional pile loops have a consistent pile loop height in conventional high-low pile towels, but uses a design method in which two or three adjacent pile loops have a inconsistent pile loop height for weaving, and at the same time uses a special dyeing and finishing treatment, whereby the dyed and finished product has a special visual effect, a strong visual impact, and a fluffy and soft hand feel, and the product therefrom has a high additional value without improving the coats, compared with the existing products. The method fills up a blank of high-low pile towels, and can be widely popularized and applied.

3 Claims, 1 Drawing Sheet

PRODUCTION METHOD FOR HIGH-LOW PILE TOWEL

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The invention belongs to the field of textile products, and particularly relates to a production method for high-low pile towel.

Description of Related Arts

With continuous development of the social economy, the requirements on commodities from consumers are increasingly high, as the article of daily use, the towel product's attractiveness draws more and more attention from people. Being the main body of towel products, the visual effect of pile loops affects the appearance and grade of the product to a large extent. As the appearance for the pile loops of ordinary towels and products thereof is of a smooth type, the height of pile loops is uniform and consistent, it gives the visual effect of a level type to people; in order to overcome such defect of conventional towels, there are manufacturers designing high-low pile towels. However, the appearance for the pile loops of such high-low pile towels and products thereof is locally level, the conversion frequency of high and low piles is low, the conversion frequency is a conventional design approach with consistency in pile loop height for at least three adjacent pile loops, and there is high-low pile conversion only when at least more than three adjacent pile loops are arranged in a group of pile loops, thus this design gives the visual sense of strong regularity. Being the main style of towels, although these towels are widely accepted in the market, it always gives the sense of monotony to people, which is difficult to touch the market. Meanwhile the hand feel of these high-low pile towels is ordinary, the overall additional value is low, and the market reaction is common; the reason is mainly that it is limited by current weaving methods and design ideas, it cannot break through the traditional process and design ideas, and it seriously limits the design and production of high-low pile towels.

SUMMARY OF THE PRESENT INVENTION

Aiming to many problems existing in current high-low pile towels, the invention provides a brand-new production method for high-low pile towels. This method solves the problem of visual monotony for conventional towels and conventional high-low pile towels and breaks through the traditional design method of ordinary consistent height for two or three adjacent pile loops, it adopts the design method with inconsistency for adjacent two or three adjacent pile loops to weave, meanwhile it employs special dyeing and finishing treatment. The product after dyeing and finishing has special visual effect, the visual impact is strong, and the hand feel is fluffy and soft. Compared with existing products, the additional value is high without improving the cost for new products, it fills in the blank of high-low pile towels, and it can be widely popularized and applied.

It adopts the following technical scheme in the invention: a production method for high-low pile towels, it mainly comprises the processes of spinning, warping and sizing, weaving as well as dyeing and polishing after weaving, the specific steps are as below:

1) Spinning: select towel yarn, the yarn count range is that single yarn: 6s to 32s, piled yarn: 40s/2-8s/2, the twist factor for pile warp is controlled to be 240 to 380, and the breaking strength is greater than 10.5 CN/tex;

2) Warping and sizing: adopt conventional warping and sizing technology, wherein the speed of a warping car is controlled to be 550 m/min, and the speed of a sizing car during sizing is controlled to be 100 m/min;

The size formula during the sizing process is that:

Pile warp: add 23.2 kg of corn starch and 2 kg of liquid wax into 1000 kg of water;

Ground warp: add 116 kg of modified starch, 2 kg of solid wax blocks and 12 kg of propylene into 1000 kg of water.

3) Weaving: it adopts a conventional high-low pile weaving method, wherein the high-low pile conversion frequency is that carry out pile loop height conversion within 3 pile loops, the high pile loop height is 1.1 to 1.6 cm per pile loop, and meanwhile control the height difference of adjacent high and low pile loops to maintain at is 0.3 to 0.5 cm per pile loop; and adjust the tensile force of pile warp yarn and ground warp yarn during the weaving process, which is respectively set to be 100-110 kgf and 270-280 kgf, and the speed of a loom is 400-450 r/min;

4) Dyeing and polishing: put the towel cloth woven by the above method into a dyeing machine at 20-25° C., then inject the desizing agent, treat at 80° C. for 20 to 30 min, remove sizing agent on the original blank, and carry out bleaching and dyeing treatment. The proportion of bleaching agent adopted during bleaching is 27 vt % hydrogen peroxide: 6 g/L, NaOH: 2 g/L, refining agent: 1.5 g/L, hydrogen peroxide stabilizer: 1 g/L, chelating agent: 1 g/L, treat at 98° C. for 55 min; then carry out polishing treatment, and finally carry out dyeing.

The process adopted in said dyeing is of a conventional type, the specific dosages of the adopted dyeing agents are as below: reactive dyes: dystar RGB red: 0.001-10%; dystar RGB yellow: 0.001-10%; and dystar RGB blue: 0.001-10%;

Anhydrous sodium sulfate: 10-100 g/l, and sodium carbonate: 5-25 g/l.

For the adopted process, it can also refer to the following method:

Inject the reactive dye at room temperature (10 min)→circulate for 10 min→add anhydrous sodium sulfate (10 min)→circulate for 10 min→add sodium carbonate (10 min)→temperature rises to 60 degrees (2 degrees/min)→color fixing (time is determined by color depth)→wash in water for 5 min→carry out thermal washing for 15 min→carry out soaping for 15 min (depend on color depth)→wash in water→soften;

The above mentioned method is a conventional process, it can be randomly adjusted as per different production requirement so as to meet the requirement of manufacturing towels of different colors and styles, and it can be directly realized by employing existing equipment, it does not give unnecessary details herein, and the above dosage of reactive dyes is percentage of fabric mass;

In the above process, the adopted desizing agent is aqueous solution of desizing enzyme, with proportion of 0.5-1 g/L, that is, add 0.5-1 g of desizing enzyme into one liter of water; and the adopted desizing enzyme is α-amylase of Novozymes, the reason for choosing this desizing enzyme is mainly that such enzyme has specificity to starch desizing, it has better desizing effect, and it can lay the foundation for the processing of subsequent working procedures.

The adopted refining agent is clarite one from Huntsman, this refining agent can be used for emulsifying water repellent substances of waxes etc. on textile, which can improve hydrophilcity of textiles;

For hydrogen peroxide stabilizer, it can select Prestogen PL hydrogen peroxide stabilizer from BASF, and it can be used for stably decomposing hydrogen peroxide to increase its utilization;

For chelating agent, it employs MSD chelating agent from BASF, it can soften water quality, reduce hardness of water, meanwhile it can chelate copper and manganese ions in water, which facilitates reducing yellow spots and increasing whiteness of the product;

There is a major difference between the invention and the prior art, that is, arrange the polishing process ahead of the dyeing process, the reason for making such a choice is mainly that after employing the high-low pile process, it can better remove fuzzy balls and lower piles mixed in pile loops, and it has better dyeing effect. It takes common polishing measures, the specific polishing process parameters: pH=4.8-5.4, the dosage of polishing enzyme: 0.1-1.0 wt %, take polishing treatment for 60 min below 50° C., the adopted polishing enzyme is B939 acid polishing enzyme from Novozymes-novoprime.

In the above mentioned method, in order to achieve the optimum high-low pile appearance as well as fluffy and soft effect during spinning, and it particularly selects coarse count low-twisted single yarn or strand yarn, such as 21s/2 weak twist piled yarn or 10s weak twist piled yarn. The inventor discovers that the effect by adopting such yarn is obviously superior to that of 21s single-yarn ordinary yarn generally applied to the existing high-low pile towels. By selecting the above mentioned yarn, with combination of the above mentioned spinning process, it can generate special visual effect, and it can also meet the basic requirement of weaving. For the parameters not mentioned in this operation, they all adopt the spinning parameters of existing ordinary high-low pile towels.

During the warping and sizing process, it selects the above mentioned suitable car speed by choosing the strength and number of warping yarns according to step 1 for warping; however, in the sizing process, it adopts the above mentioned starching process and sizing agent for pile warp yarn, it solves the problems of low strength of weak twist yarn, multiple broken ends and poor weaver's beam quality, meanwhile it realizes suitable and smooth hairiness, it increases strength and abrasion resistance, and it can ensure to achieve the weaving requirement. By selecting corn starch as main sizing agent, it can improve strength of yarn and realize smooth yarn hairiness, and by using liquid wax, it can make sure that the yarn is wear-resistant;

Ground warp adopts the above mentioned starching process and sizing agent, it improves abrasion resistance and strength of yarn, which ensures that the weaving efficiency is good; meanwhile, it adopts solid wax to use in afterwaxing, the obtained yarn is smoother than that by utilizing liquid wax, and it can get better using effect.

During the weaving process, the above mentioned parameters are controlled, the high and low pile conversion frequency is one high pile one low pile circulation or one high pile two low piles circulation or two high piles one low pile circulation or two high piles two low piles circulation, they can all guarantee pile height conversion within 3 pile loops, so that it reaches the purpose of optimum fluffy pile loop effect and prominent visual effect, and further increases the additional value of the products.

During the dyeing and polishing process, it is required to carry out bleaching and dyeing treatment on blank towels, however, in the whole process, it should note the soft and fluffy performance and the cleanliness of appearance after washing, hence the inventor specifies dosage for various auxiliaries and processing time, meanwhile, since such highly frequent high and low pile conversion in the invention can enable that there is voids between the high and the low piles of a towel, in the dyeing and finishing process, fallen piles can more easily hide in high pile loops, which affects the using process of towels. Consequently, the inventor specifies to enhance the above mentioned polishing treatment and washing treatment, so as to eliminate hiding of fuzzy balls caused by low piles within high and low pile loops to affect usage, and it further improves comfort degree of the product in use.

According to the above mentioned process and method, in order to further improve usability of towels, the inventor further employs softening agent to carry out treatment. The adopted softening agent belongs to hydrophilic fatty acid amide derivatives, and particularly it can select AQUA-SOFTER FX manufactured by AIRI CHEMICAL CO., LTD.

For process control procedures and parameters not mentioned in the above production process, they employ the parameters and control process of existing ordinary high and low pile production process, and it is not in detailed description herein.

To sum up, by adopting the special method provided by the invention, it can obtain brand-new high-low pile towels completely differing from the existing high-low pile towels, it breaks through visual monotony of common towels and conventional high-low pile towels, and it also breaks through the traditional design method with consistent pile loop height for ordinary three adjacent pile loops. It adopts the design method with inconsistent pile loop height for the adjacent two pile loops or three pile loops, meanwhile it adopts special dyeing and finishing treatment, after dyeing and finishing, the product has special visual effect, the visual impact is strong, the hand feel is fluffy and soft. Compared with existing products, the additional value is high without improving the cost for new products, it fills in the blank of high-low pile towels, and it can be widely popularized and applied.

Figure 1:
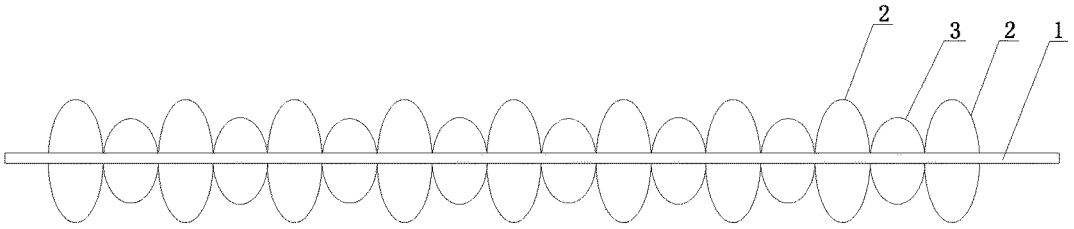
FIG. 1 is structure diagram of high-low pile towels obtained in the embodiment 1 of the invention.
Figure 2:
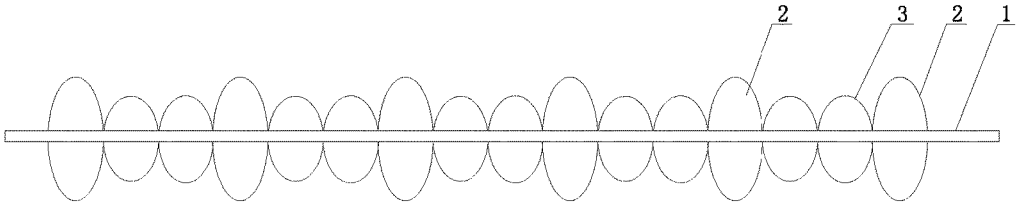
FIG. 2 is structure diagram of high-low pile towels obtained in the embodiment 2 of the invention.
Figure 3:
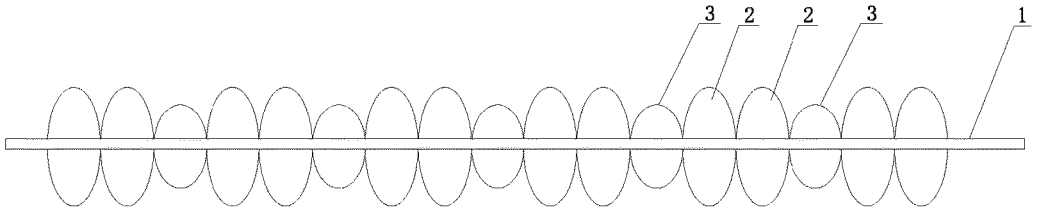
FIG. 3 is structure diagram of high-low pile towels obtained in the embodiment 3 of the invention.
Figure 4:
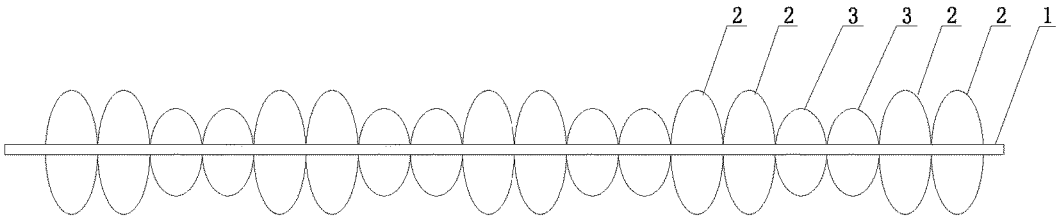
FIG. 4 is structure diagram of high-low pile towels obtained in the embodiment 4 of the invention.

In the figures, 1 refers to the basal plane of a towel, 2 refers to high pile loops, and 3 refers to low pile loops.

DETAILED DESCRIPTION OF THE PREFERRED EMBODIMENT

Embodiment 1

A production method for high-low pile towels, and the specific steps are as below:

1) Spinning: select towel yarn, the yarn count range is that single yarn: 6 s to 32s, piled yarn: 40s/2-8 s/2, the twist factor for pile warp is controlled to be 240 to 380, and the breaking strength is greater than 10.5 CN/tex; and the adopted yarn is 21s/2 weak twist piled yarn or 10s weak twist piled yarn;

2) Warping and sizing: it adopts conventional warping and sizing technology, particularly it can refer to the following:

Number of warping yarns: 500, length: 5000 m, number of warp beams: 4, yarn count: 21s/2, beam width: 2 m, warping equipment: Benninger warping machine, warping car speed: 500-600 m/min;

Sizing yarn length: 5000 m, number of sizing yarns: 2000, yarn count: 21s/2, disc width: 186 cm, size concentration: 3%, size volume: 7001, unwinding tension: 250N, feeding tensile force: 200N, wet zone tensile force: 350N, squeezing pressure N1/N2: 8 Kn/12 Kn, dry zone tensile force: 1200N, winding tension: 1600N, toppin roller pressure: 1600N, extrusion weighing percentage: 100%, size immersion method: single immersion and single rolling, size temperature: 90° C., moisture regaining rate: 7%, elongation rate: 1%;

It is optimum to control the warping car speed at 550 m/min and the sizing car speed during the sizing process at 100 m/min;

The formula for sizing agent during the sizing process:

Pile warp: add 23.2 kg of corn starch and 2 kg of liquid wax into 1000 kg of water;

Ground warp: add 116 kg of modified corn starch (can be directly purchased from the market), 2 kg of solid wax blocks and 12 kg of propylene into 1000 kg of water.

3) Weaving: it adopts a conventional high-low pile weaving method, wherein the high-low pile conversion frequency is one high pile and one low pile circulation, the high pile loop height is 1.1 to 1.6 cm per pile loop, and meanwhile control the height difference of adjacent high and low pile loops to maintain at is 0.3 to 0.5 cm per pile loop; and adjust the tensile force of pile warp yarn and ground warp yarn during the weaving process, which is respectively set to be 100-110 kgf and 270-280 kgf, and the speed of a loom is 400-450 r/min;

4) Dyeing and polishing: put the towel cloth woven by the above method into a dyeing machine at 20-25° C., then inject the desizing agent, treat at 80° C. for 20 to 30 min, remove sizing agent on the original blank, and carry out bleaching and dyeing treatment. The proportion of bleaching agent adopted during bleaching is 27 vt % hydrogen peroxide: 6 g/L, NaOH: 2 g/L, refining agent: 1.5 g/L, hydrogen peroxide stabilizer: 1 g/L, chelating agent: 1 g/L, treat at 98° C. for 55 min; then carry out polishing treatment, and finally carry out dyeing;

Then carry out dyeing treatment on towels after processing, the adopted process is a conventional process during dyeing, the specific dosages of the adopted dyeing agents are as below: reactive dyes: dystar RGB red: 0.001-10%; dystar RGB yellow: 0.001-10%; and dystar RGB blue: 0.001-10%; Anhydrous sodium sulfate: 10-100 g/l, and sodium carbonate: 5-25 g/l, For the adopted process, it can also refer to the following method:

Inject the reactive dye at room temperature (10 min)→circulate for 10 min→add anhydrous sodium sulfate (10 min)→circulate for 10 min→add sodium carbonate (10 min)→temperature rises to 60 degrees (2 degrees/min)→color fixing (time is determined by color depth)→wash in water for 5 min→carry out thermal washing for 15 min→carry out soaping for 15 min (depend on color depth)→wash in water→soften;

In addition to this, it can adopt other conventional processes and reactive dye formulas;

In the above process, the adopted desizing agent is aqueous solution of desizing enzyme, with proportion of 0.5-1 g/L, that is, add 0.5-1 g of desizing enzyme into one liter of water; and the adopted desizing enzyme is α-amylase of Novozymes;

The adopted refining agent is clarite one from Huntsman;

For hydrogen peroxide stabilizer, it can select Prestogen PL hydrogen peroxide stabilizer from BASF;

For chelating agent, it employs MSD chelating agent from BASF;

The said polishing process is as blow:

It takes conventional polishing measures, the specific polishing process parameters: pH=4.8-5.4, the dosage of polishing enzyme: 0.2 wt %, take polishing treatment for 60 min below 50° C., the adopted polishing enzyme is B939 acid polishing enzyme from Novozymes-novoprime;

After dyeing, in order to further improve usability of towels, the inventor further employs softening agent to carry out treatment. The adopted softening agent belongs to hydrophilic fatty acid amide derivatives, and particularly it can select AQUASOFTER FX manufactured by AIRI CHEMICAL CO., LTD.;

Besides the above mentioned parameters, other processes and parameters adopted by the embodiment are similar to the weaving method for ordinary towels in the existing technology, and they are not in detailed description herein.

Embodiment 2

A production method for high-low pile towels, and the specific steps are as below:

1) Spinning: select towel yarn, the yarn count range is that single yarn: 6 s to 32s, piled yarn: 40s/2-8s/2, the twist factor for pile warp is controlled to be 240 to 380, and the breaking strength is greater than 10.5 CN/tex; and the adopted yarn is 21s/2 weak twist piled yarn or 10s weak twist piled yarn;

2) Warping and sizing: it adopts conventional warping and sizing technology:

Warping: warping equipment: Benninger high-speed warping machine, yarn count: 12s ring spinning, number of warping yarns: 500, number of warp beams: 4, warping car speed: 600 m/min; beam width: 200 cm, beam length: 2000 m;

Sizing: sizing equipment: kal-mayer sizing machine, yarn count: 12s, number of sizing yarns: 2000, size concentration: 2%, size temperature: 90° C., unwinding tension: 300N, feeding tensile force: 250N, wet zone tensile force: 300N, dry zone tensile force: 1100N, winding tension: 1600N, toppin roller pressure: 1600N, moisture regaining rate: 7.0%, elongation rate: 0.8%, size immersion method: double immersion and double rolling, and to control the sizing car speed during the sizing process at 100 m/min;

The formula for sizing agent during the sizing process:

Pile warp: add 23.2 kg of corn starch and 2 kg of liquid wax into 1000 kg of water;

Ground warp: add 116 kg of modified corn starch, 2 kg of solid wax blocks and 12 kg of propylene into 1000 kg of water.

3) Weaving: it adopts a conventional high-low pile weaving method, wherein the high-low pile conversion frequency is one high pile and two low piles circulation, the high pile loop height is 1.1 to 1.6 cm per pile loop, and meanwhile control the height difference of adjacent high and low pile loops to maintain at is 0.3 to 0.5 cm per pile loop; and adjust the tensile force of pile warp yarn and ground warp yarn during the weaving process, which is respectively set to be 100-110 kgf and 270-280 kgf, and the speed of a loom is 400-450 r/min;

4) Dyeing and polishing: put the towel cloth woven by the above method into a dyeing machine at 20-25° C., then inject the desizing agent, treat at 80° C. for 20 to 30 min, remove sizing agent on the original blank, and carry out bleaching and dyeing treatment. The proportion of bleaching agent adopted during bleaching is 27 vt % hydrogen peroxide: 6 g/L, NaOH: 2 g/L, refining agent: 1.5 g/L, hydrogen peroxide stabilizer: 1 g/L, chelating agent: 1 g/L, treat at 98° C. for 55 min; then carry out polishing treatment;

Then carry out dyeing treatment on towels after processing, the adopted process is a conventional process during dyeing, the specific dosages of the adopted dyeing agents are as below: reactive dyes: dystar RGB red: 0.001-10%; dystar RGB yellow: 0.001-10%; and dystar RGB blue: 0.001-10%;

Anhydrous sodium sulfate: 10-100 g/l, and sodium carbonate: 5-25 g/l,

For the adopted process, it can also refer to the following method:

Inject the reactive dye at room temperature (10 min)→circulate for 10 min→add anhydrous sodium sulfate (10 min)→circulate for 10 min→add sodium carbonate (10 min)→temperature rises to 60 degrees (2 degrees/min)→color fixing (time is determined by color depth)→wash in water for 5 min→carry out thermal washing for 15 min→carry out soaping for 15 min (depend on color depth)→wash in water→soften;

In addition to this, it can adopt other conventional processes and reactive dye formulas;

In the above process, the adopted desizing agent is aqueous solution of desizing enzyme, with proportion of 0.5-1 g/L, that is, add 0.5-1 g of desizing enzyme into one liter of water; and the adopted desizing enzyme is α-amylase of Novozymes;

The adopted refining agent is clarite one from Huntsman;

For hydrogen peroxide stabilizer, it can select Prestogen PL hydrogen peroxide stabilizer from BASF;

For chelating agent, it employs MSD chelating agent from BASF;

The said polishing process is as blow:

It takes conventional polishing measures, the specific polishing process parameters: pH=4.8-5.4, the dosage of polishing enzyme: 0.1 wt %, take polishing treatment for 60 min below 50° C., the adopted polishing enzyme is B939 acid polishing enzyme from Novozymes-novoprime;

After dyeing, in order to further improve usability of towels, the inventor further employs softening agent to carry out treatment. The adopted softening agent belongs to hydrophilic fatty acid amide derivatives, and particularly it can select AQUASOFTER FX manufactured by AIRI CHEMICAL CO., LTD.;

Besides the above mentioned parameters, other processes and parameters adopted by the embodiment are similar to the weaving method for ordinary towels in the existing technology, and they are not in detailed description herein.

Embodiment 3

A production method for high-low pile towels, and the specific steps are as below:

1) Spinning: select towel yarn, the yarn count range is that single yarn: 6s to 32 s, piled yarn: 40s/2-8s/2, the twist factor for pile warp is controlled to be 240 to 380, and the breaking strength is greater than 10.5 CN/tex; and the adopted yarn is 21s/2 weak twist piled yarn or 10 s weak twist piled yarn;

2) Warping and sizing: it adopts conventional warping and sizing technology, particularly it can refer to the following:

Number of warping yarns: 500, length: 5000 m, number of warp beams: 4, yarn count: 21s/2, beam width: 2 m, warping equipment: Benninger warping machine, warping car speed: 500-600 m/min;

Sizing yarn length: 5000 m, number of sizing yarns: 2000, yarn count: 21s/2, disc width: 186 cm, size concentration: 3%, size volume: 7001, unwinding tension: 250N, feeding tensile force: 200N, wet zone tensile force: 350N, squeezing pressure N1/N2: 8 Kn/12 Kn, dry zone tensile force: 1200N, winding tension: 1600N, toppin roller pressure: 1600N, extrusion weighing percentage: 100%, size immersion method: single immersion and single rolling, size temperature: 90° C., moisture regaining rate: 7%, elongation rate: 1%;

It is optimum to control the warping car speed at 500 m/min and the sizing car speed during the sizing process at 100 m/min;

The formula for sizing agent during the sizing process:

Pile warp: add 23.2 kg of corn starch and 2 kg of liquid wax into 1000 kg of water;

Ground warp: add 116 kg of modified corn starch, 2 kg of solid wax blocks and 12 kg of propylene into 1000 kg of water.

3) Weaving: it adopts a conventional high-low pile weaving method, wherein the high-low pile conversion frequency is two high piles and one low pile circulation, the high pile loop height is 1.1 to 1.6 cm per pile loop, and meanwhile control the height difference of adjacent high and low pile loops to maintain at is 0.3 to 0.5 cm per pile loop; and adjust the tensile force of pile warp yarn and ground warp yarn during the weaving process, which is respectively set to be 100-110 kgf and 270-280 kgf, and the speed of a loom is 400-450 r/min;

4) Dyeing and polishing: put the towel cloth woven by the above method into a dyeing machine at 20-25° C., then inject the desizing agent, treat at 80° C. for 20 to 30 min, remove sizing agent on the original blank, and carry out bleaching and dyeing treatment. The proportion of bleaching agent adopted during bleaching is 27 vt % hydrogen peroxide: 6 g/L, NaOH: 2 g/L, refining agent: 1.5 g/L, hydrogen peroxide stabilizer: 1 g/L, chelating agent: 1 g/L, treat at 98° C. for 55 min; then carry out polishing treatment;

Then carry out dyeing treatment on towels after processing, the adopted process is a conventional process during dyeing, the specific dosages of the adopted dyeing agents are as below: reactive dyes: dystar RGB red: 0.001-10%; dystar RGB yellow: 0.001-10%; and dystar RGB blue: 0.001-10%;

Anhydrous sodium sulfate: 10-100 g/l, and sodium carbonate: 5-25 g/l,

For the adopted process, it can also refer to the following method:

Inject the reactive dye at room temperature (10 min)→circulate for 10 min→add anhydrous sodium sulfate (10 min)→circulate for 10 min→add sodium carbonate (10 min)→temperature rises to 60 degrees (2 degrees/min)→color fixing (time is determined by color depth)→wash in water for 5 min→carry out thermal washing for 15 min→carry out soaping for 15 min (depend on color depth)→wash in water→soften;

In addition to this, it can adopt other conventional processes and reactive dye formulas;

In the above process, the adopted desizing agent is aqueous solution of desizing enzyme, with proportion of 0.5-1 g/L, that is, add 0.5-1 g of desizing enzyme into one liter of water; and the adopted desizing enzyme is α-amylase of Novozymes;

The adopted refining agent is clarite one from Huntsman;

For hydrogen peroxide stabilizer, it can select Prestogen PL hydrogen peroxide stabilizer from BASF;

For chelating agent, it employs MSD chelating agent from BASF;

The said polishing process is as blow:

It takes conventional polishing measures, the specific polishing process parameters: pH=4.8-5.4, the dosage of polishing enzyme: 0.5 wt %, take polishing treatment for 60 min below 50° C., the adopted polishing enzyme is B939 acid polishing enzyme from Novozymes-novoprime;

After dyeing, in order to further improve usability of towels, the inventor further employs softening agent to carry out treatment. The adopted softening agent belongs to hydrophilic fatty acid amide derivatives, and particularly it can select AQUASOFTER FX manufactured by AIRI CHEMICAL CO., LTD.;

Besides the above mentioned parameters, other processes and parameters adopted by the embodiment are similar to the weaving method for ordinary towels in the existing technology, and they are not in detailed description herein.

Embodiment 4

A production method for high-low pile towels, and the specific steps are as below:

1) Spinning: select towel yarn, the yarn count range is that single yarn: 6s to 32s, piled yarn: 40s/2-8s/2, the twist factor for pile warp is controlled to be 240 to 380, and the breaking strength is greater than 10.5 CN/tex; and the adopted yarn is 21s/2 weak twist piled yarn or 10s weak twist piled yarn, 2) Warping and sizing: it adopts conventional warping and sizing technology:

Warping: warping equipment: Benninger high-speed warping machine, yarn count: 12s ring spinning, number of warping yarns: 500, number of warp beams: 4, warping car speed: 600 m/min; beam width: 200 cm, beam length: 2000 m;

Sizing: sizing equipment: kal-mayer sizing machine, yarn count: 12s, number of sizing yarns: 2000, size concentration: 2%, size temperature: 90° C., unwinding tension: 300N, feeding tensile force: 250N, wet zone tensile force: 300N, dry zone tensile force: 1100N, winding tension: 1600N, toppin roller pressure: 1600N, moisture regaining rate: 7.0%, elongation rate: 0.8%, size immersion method: double immersion and double rolling, and to control the sizing car speed during the sizing process at 100 m/min;

The formula for sizing agent during the sizing process:

Pile warp: add 23.2 kg of corn starch and 2 kg of liquid wax into 1000 kg of water;

Ground warp: add 116 kg of modified corn starch, 2 kg of solid wax blocks and 12 kg of propylene into 1000 kg of water.

3) Weaving: it adopts a conventional high-low pile weaving method, wherein the high-low pile conversion frequency is two high piles and two low piles circulation, the high pile loop height is 1.1 to 1.6 cm per pile loop, and meanwhile control the height difference of adjacent high and low pile loops to maintain at is 0.3 to 0.5 cm per pile loop; and adjust the tensile force of pile warp yarn and ground warp yarn during the weaving process, which is respectively set to be 100-110 kgf and 270-280 kgf, and the speed of a loom is 400-450 r/min;

4) Dyeing and polishing: put the towel cloth woven by the above method into a dyeing machine at 20-25° C., then inject the desizing agent, treat at 80° C. for 20 to 30 min, remove sizing agent on the original blank, and carry out bleaching and dyeing treatment. The proportion of bleaching agent adopted during bleaching is 27 vt % hydrogen peroxide: 6 g/L, NaOH: 2 g/L, refining agent: 1.5 g/L, hydrogen peroxide stabilizer: 1 g/L, chelating agent: 1 g/L, treat at 98° C. for 55 min; then carry out polishing treatment;

Then carry out dyeing treatment on towels after processing, the adopted process is a conventional process during dyeing, the specific dosages of the adopted dyeing agents are as below: reactive dyes: dystar RGB red: 0.001-10%; dystar RGB yellow: 0.001-10%; and dystar RGB blue: 0.001-10%;

Anhydrous sodium sulfate: 10-100 g/l, and sodium carbonate: 5-25 g/l,

For the adopted process, it can also refer to the following method:

Inject the reactive dye at room temperature (10 min)→circulate for 10 min→add anhydrous sodium sulfate (10 min)→circulate for 10 min→add sodium carbonate (10 min)→temperature rises to 60 degrees (2 degrees/min)→color fixing (time is determined by color depth)→wash in water for 5 min→carry out thermal washing for 15 min→carry out soaping for 15 min (depend on color depth)→wash in water→soften;

In addition to this, it can adopt other conventional processes and reactive dye formulas;

In the above process, the adopted desizing agent is aqueous solution of desizing enzyme, with proportion of 0.5-1 g/L, that is, add 0.5-1 g of desizing enzyme into one liter of water; and the adopted desizing enzyme is α-amylase of Novozymes;

The adopted refining agent is clarite one from Huntsman;

For hydrogen peroxide stabilizer, it can select Prestogen PL hydrogen peroxide stabilizer from BASF;

For chelating agent, it employs MSD chelating agent from BASF;

The said polishing process is as blow:

It takes conventional polishing measures, the specific polishing process parameters: pH=4.8-5.4, the dosage of polishing enzyme: 1.0 wt %, take polishing treatment for 60 min below 50° C., the adopted polishing enzyme is B939 acid polishing enzyme from Novozymes-novoprime;

After dyeing, in order to further improve usability of towels, the inventor further employs softening agent to carry out treatment. The adopted softening agent belongs to hydrophilic fatty acid amide derivatives, and particularly it can select AQUASOFTER FX manufactured by AIRI CHEMICAL CO., LTD.;

Besides the above mentioned parameters, other processes and parameters adopted by the embodiment are similar to the weaving method for ordinary towels in the existing technology, and they are not in detailed description herein.

What is claimed is:

1. A method for producing high-low pile towels, comprising the steps of:

(a) selecting a towel yarn which comprises a single yarn and a piled yarn, wherein the towel yarn has a yarn count range for a single yarn of 6 s to 32 s and yarn count range for a piled yarn of 40s/2 to 8s/2, wherein a twist factor for the pile warp is controlled to be 240 to 380, and the breaking strength is greater than 10.5 CN/tex;

(b) warping the yarn, wherein a speed of a warping car is controlled to be 550 m/min;

(b.1) preparing a sizing formula by adding 23.2 kg corn starch and 2 kg liquid wax into 1000 kg water or adding 116 kg of modified starch, 2 kg solid wax blocks and 12 kg of propylene into 1000 kg of water and sizing the yarn with the sizing formula, wherein the speed of a sizing car during sizing is controlled to be 100 m/min;

(c) weaving the high-low pile, wherein the high-low pile conversion frequency is set as a pile loop height conversion within 3 pile loops, wherein the high pile loop height is 1.1 to 1.6 cm per pile loop, the height difference of adjacent high and low pile loops is maintained at 0.3 to 0.5 cm per pile loop; and the tensile force of the pile warp yarn and a ground warp yarn during weaving is set at 100-110 kgf and 270-280 kgf, respectively, and the speed of the loom is 400-450 r/min;

(d) putting the woven towel cloth into a dyeing machine at 20-25° C., injecting the desizing agent into the dyeing machine, wherein the desizing agent is an aqueous solution of 0.5 to 1 g/L α-amylase in water, treating the cloth at 80° C. for 20 to 30 min to remove the sizing agent, bleaching at 98° C. for 55 min, wherein the bleaching agent contains 6 g/L hydrogen peroxide, 2 g/L NaOH, 1.5 g/L refining agent, 1 g/L hydrogen peroxide stabilizer and 1 g/L chelating agent;

(e) polishing for 60 minutes at 50° C. with a polishing formula of pH 4.8-5.4comprising 0.1 to 1.0 wt % of polishing enzyme;

(f) dyeing; and (g) after dyeing, softening with a hydrophilic fatty acid amide derivative.

2. The method according to claim 1, wherein the high and low pile conversion frequency is one high pile one low pile circulation, one high pile two low piles circulation, two high piles one low pile circulation or two high piles two low piles circulation.

3. The method according to claim 1, wherein the high and low pile conversion frequency is one high pile one low pile circulation.

* * * * *